US006800001B1

(12) United States Patent
Costa

(10) Patent No.: US 6,800,001 B1
(45) Date of Patent: Oct. 5, 2004

(54) SOCKET CONNECTOR FOR LEAD WIRE TERMINATION AND METHOD OF USING THE SAME

(76) Inventor: Larry J. Costa, 55613 Currant Rd., Mishawaka, IN (US) 46545

( * ) Notice: Subject to any disclaimer, the term of this patent is extended or adjusted under 35 U.S.C. 154(b) by 0 days.

(21) Appl. No.: 10/390,059

(22) Filed: Mar. 14, 2003

(51) Int. Cl.[7] ..... H01R 13/02
(52) U.S. Cl. ..... 439/888; 439/860; 439/859
(58) Field of Search ..... 439/888, 859, 439/860, 930, 931, 909

(56) References Cited

U.S. PATENT DOCUMENTS 3,014,977 A * 12/1961 Geiser ..... 174/52.1
4,382,650 A * 5/1983 Herrmann, Jr. ..... 439/278
4,671,591 A * 6/1987 Archer ..... 439/346
5,897,406 A 4/1999 Benes et al. ..... 439/859
5,980,338 A 11/1999 Le Pottier et al. ..... 439/859

* cited by examiner

*Primary Examiner*—Tho D. Ta
(74) *Attorney, Agent, or Firm*—Thomte, Mazour & Niebergall; Shane M. Niebergall

(57) ABSTRACT

A socket mating connector is provided for use in securing a lead wire to a post terminal. The connector includes a top wall and a side wall extending downwardly therefrom, forming an inner cavity that is shaped to receive a portion of the lead wire and the post terminal. The side wall of the connector includes at least one compression slot that is shaped to securely receive the lead wire as it enters the inner cavity. The lead wire can be connected to the inner cavity by soldering or welding to increase the strength of the mechanical connection. The terminal end of the lead wire can also be shaped to resist pulling the lead wire through the compression slot.

28 Claims, 2 Drawing Sheets

SOCKET CONNECTOR FOR LEAD WIRE TERMINATION AND METHOD OF USING THE SAME

BACKGROUND OF THE INVENTION

1. Field of the Invention

The present invention relates to electrical connectors, and more particularly to a novel socket connector for use in the connection of one or more lead wires to a post connector.

2. Description of the Prior Art

Electrical terminals are frequently used to connect certain articles of manufacture to allow for the flow of electricity from one article to another. Snap terminals are sometimes employed in this fashion. Snap terminals are generally two-piece terminals which are arranged in a mating configuration. Each of the terminals is electrically and mechanically connected to a component and the snap terminal components are then mated to form a releasable electrical and/or mechanical connection between the components. Snap terminals are often used to electrically connect a power source to the conductive elements embedded in a non-conductive material such as glass or dielectric substrate. For example, snap terminals can be used to provide a point of connection for electrical current in automotive glass panels that have electrical wiring embedded therein for the purpose of defogging the window.

The termination of a heavy lead wire to a socket mating lead wire is usually accomplished using an external compression tab that extends radially from the main round body of the mating connector. One example of such a connector is disclosed in U.S. Pat. No. 5,980,338. However, these structural features significantly increase the material usage when manufacturing the connector and also increase the footprint of to the interconnection. Moreover, the features limit the mechanical pull strength of the lead wire to the strength of the crimp or, if soldered, the point of connection between the compression tab to the main round body of the mating connector. Another problem with the prior art connectors is that separate configurations may be necessary in a single application, depending on the size of the lead wires used. The termination of a light lead wire to a socket mating lead wire is typically accomplished by soldering the lead wire to the location where it exits the center hole detail from the flat surface or by crimping the wire using tabs that extend from the flat surface.

Accordingly, what is needed is a socket mating connector that is simple to manufacture, adaptable for use in multiple applications, and will provide improved mechanical pull strength of the lead wire connection.

SUMMARY OF THE INVENTION

A socket mating connector is described for use in securing a lead wire to a post terminal. The connector generally includes a top wall and a side wall, which extends downwardly therefrom to form an inner cavity that is shaped to receive a portion of the lead wire and the post terminal. The side wall of the connector includes at least one compression slot that is shaped to securely receive the lead wire as it enters the inner cavity. A slightly upturned lip can be provided at the bottom of the side wall to facilitate the removal of the connector from the post terminal or the retention of a snap ring, which can be applied to increase the mating contact pressure.

The lead wire can be connected to the inner surface of the inner cavity by one of many methods, including soldering, bonding or welding, to increase the strength of the mechanical connection between the lead wire and the connector. The strength of the mechanical connection can also be increased by shaping the terminal end of the lead wire into a coil or other such shape which will resist pulling the lead wire through the compression slot.

In another embodiment, multiple compression slots can be formed in the side wall. One such embodiment uses compression slots of different widths to accommodate the use of lead wires of different diameters. The compression slots can be spaced along the side wall in any necessary orientation for a specific use. In another such embodiment, multiple compression slots can be used to connect a lead wire that is run in series.

It is therefore a principal object of the invention to provide a socket mating connector capable of use with a variety of methods of mechanically connecting the socket mating connector to a lead wire with a minimal interconnection footprint and minimal material usage.

A further object of the invention is to provide a socket mating connector that is at least partially secured to a lead wire using a compression slot.

Yet another object of the invention is to provide a socket mating connector that is capable of simply coupling multiple lead wires to a post terminal.

Still another object of the invention is to provide a socket mating connector that is capable of simply coupling lead wires of different diameters to a post terminal.

A further object of the invention is to provide a socket mating connector that is capable of coupling a series-run lead wire to a post terminal.

Yet another object of the invention is to provide a socket mating connector having a lower, up-turned lip for easy separation of the socket mating connector from a post terminal.

Still another object of the invention is to provide a socket mating connector that is simple in manufacture design.

These and other objects will be apparent to those skilled in the art.

DESCRIPTION OF THE PREFERRED EMBODIMENT

Figure 1:
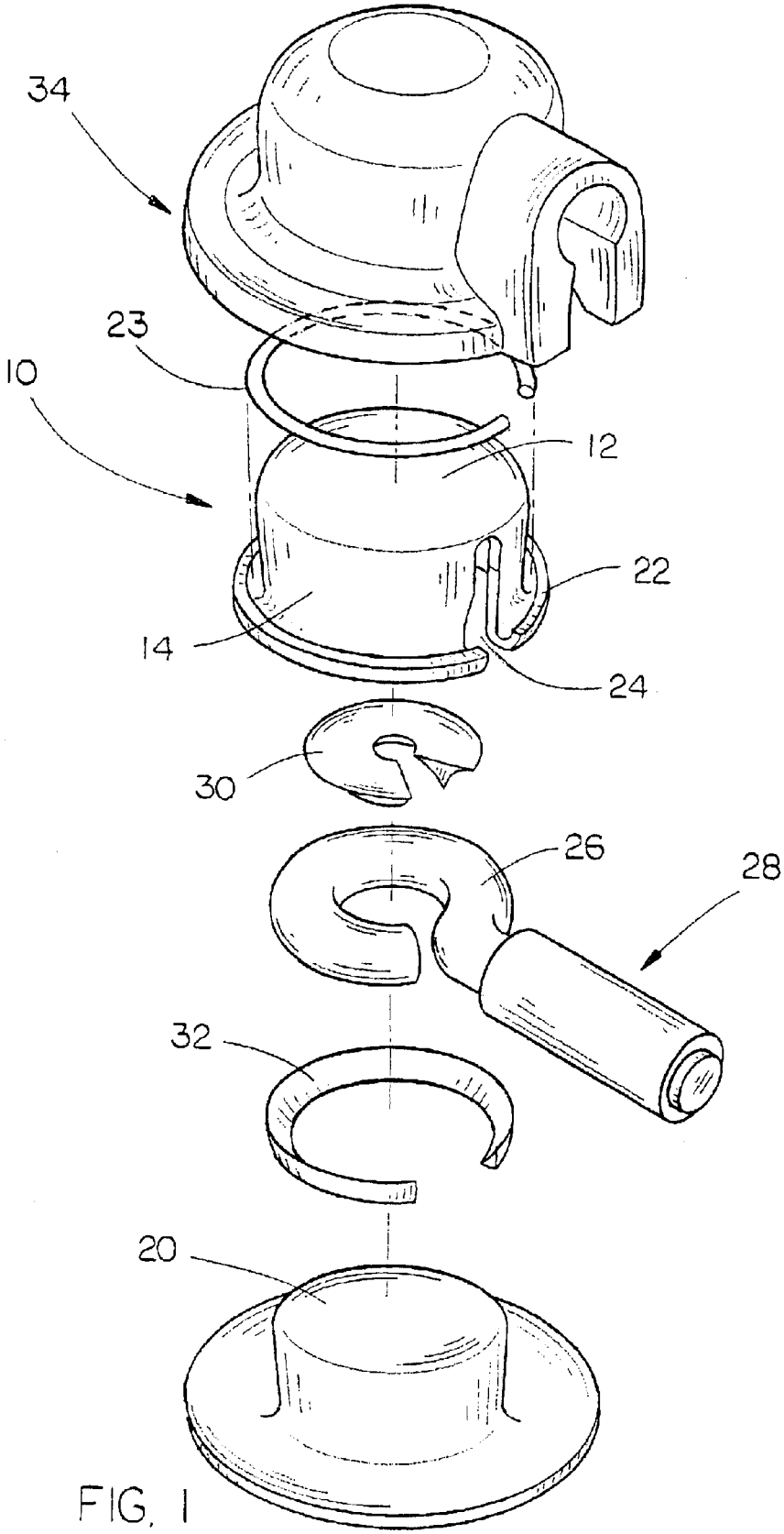
FIG. 1 is an exploded view of one embodiment of the present invention.
Figure 2:
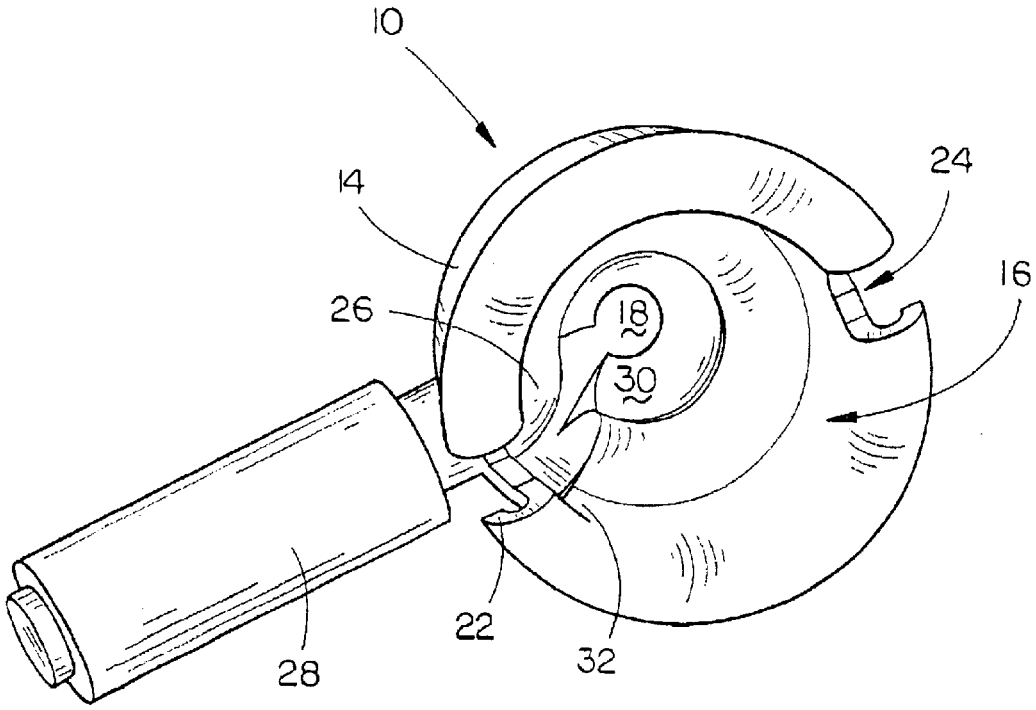
FIG. 2 is a bottom perspective view of one embodiment of the present invention.

The numeral 10 refers generally to the socket mating connector of this invention. The connector 10 is preferably hat-shaped, having a generally circular top wall 12 and a side wall 14 which extends downwardly in a generally perpendicular manner from the periphery of the top wall 12. However, it is contemplated that the body member 12 can be formed to have nearly any shape required by a particular application and use with a post terminal having a particular shape. The top wall 12 and side wall 14 form an inner cavity 16, having an inner surface 18 that is shaped to receive a post terminal 20. The side wall 14 is preferably provided with a flange 22 which extends generally outwardly and upwardly from the side wall 14. The shape of flange 22 allows the connector 10 to be quickly and easily separated from the post terminal 20 and optionally locate a retention ring 23, which can be used to increase the mating contact pressure exerted between the side wall 14 of the connector 10 and the post terminal 20.

The side wall 14 of the connector 10 is provided with at least one compression slot 24 to receive the terminal end 26 of a lead wire 28. It is contemplated that the width of the compression slot 24 could be sized to securably receive any gauge lead wire. Multiple compression slots 24 can be formed in any location in the side wall 14 when more than one lead wire 28 will terminate at the connector 10. A pair of opposing compression slots 24 can also be formed in the side wall 14 for use with a lead wire 28 that is run in series.

In use, the terminal end 26 of a lead wire 28 is disposed within the inner cavity 16 of the connector 10, closely adjacent the inner surface 18, so that the lead wire 28 exits the connector through the compression slot 24. In an application where the strength of the mechanical connection between the lead wire 28 and the terminal assembly is less important, the connector can simply be press-fit onto the post terminal 20. The strength of the mechanical connection can be increased in a number of ways. By first forming the terminal end 26 of the lead wire 28 into a coil or other such shape (as shown in FIG. 1) and then disposing the terminal end 26 into the inner cavity 16 and the compression slot 24, the terminal end 26 will resist being pulled through the compression slot 24 when the connector 10 is coupled to the post terminal 20. The terminal end 26 of the lead wire 28 can also be cleaned of any insulation or covering and then secured to the inner surface 18 of the inner cavity 16 using one of many known methods of adhesion. For example, the inner surface 18 and the clean terminal end 26 can be first coated with a layer of solderable material and a layer of flux (when necessary). Then the solderable material can be melted, creating an inner solder fillet 30 and an outer solder fillet 32, to adhere the terminal end 26 to the inner surface 18. It is also contemplated that the cleaned terminal end 26 could be welded to the inner surface 18 using an electrode or other such device. Other materials that could be used include most known electrically conductive adhesives. It is contemplated that any of the aforegoing adhesion methods could be used alone or in conjunction with the step of shaping the terminal end 26, discussed previously. The reciprocal is also true. However, it should be noted that when a soldering or welding method is not used, the step of cleaning the terminal end 26 may not be necessary to the extent that the compression slot 24 cleans a portion of the lead wire 28 and makes an electrical connection.

Figure 3:
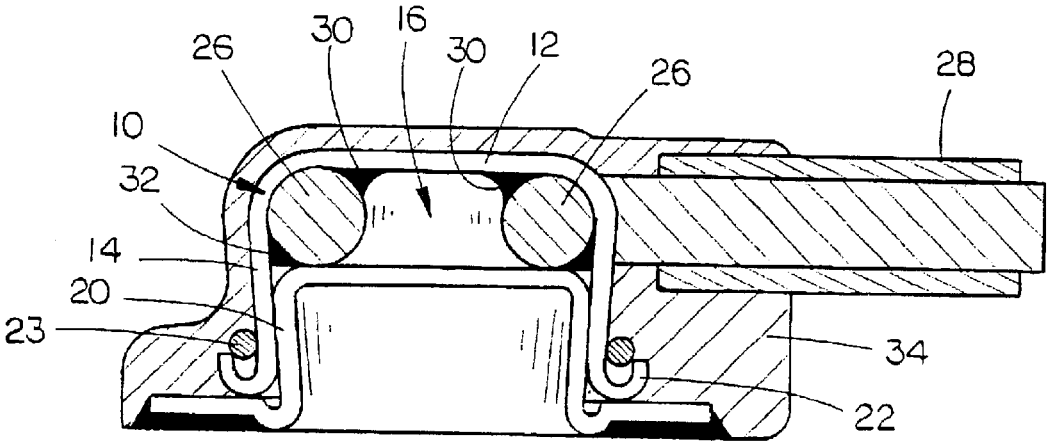
FIG. 3 is a sectional side elevational view of an assembled embodiment of the present invention.

A dielectric cover 34 can be provided and secured to the assembled terminal, as shown in FIGS. 1 and 3. The dielectric cover 34 may be press-fit onto the aforementioned structural features and modified accordingly.

In the drawings and in the specification, there have been set forth preferred embodiments of the invention; and although specified items are employed, these are used in a generic and descriptive sense only and not for purposes of limitation. Changes in the form and proportion of parts, as well as substitute of equivalents, are contemplated as circumstances may suggest or render expedient without departing from the spirit or scope of the invention as further defined in the following claims.

Thus it can be seen that the invention accomplishes at least all of its stated objectives.

I claim:

1. An electrically conductive socket connector for use in securing a lead wire to a post terminal comprising:

a top wall having a periphery;

a generally annular side wall extending generally perpendicularly from the periphery of said top wall; said top wall and said side wall being shaped to form an inner cavity to receive at least a portion of the post terminal; and at least one open-ended compression slot formed in said side wall; said compression slot being shaped to receive at least a portion of the lead wire.

2. The socket connector of claim 1 further comprising a flange extending outwardly from said side wall.

3. The socket connector of claim 2 further comprising a retention ring selectively coupled to an exterior surface of said side wall so that said retention ring applies a compressing force on said side wall.

4. A method of securing a lead wire to a terminal, comprising the steps of:

providing the terminal with a base, having a post member, and an electrically conductive socket connector, having a top wall with a periphery and a side wall extending from said periphery; said side wall having at least one open-ended compression slot formed therein; said top and side walls being shaped to form an inner cavity;

positioning a free end of the lead wire within the inner cavity of said socket connector so that the lead wire exits said socket connector through said compression slot; and positioning at least a portion of the post member of said base within the inner cavity of said socket connector.

5. The method of claim 4 further comprising the step of shaping the free end of said lead wire prior to inserting said free end within the inner cavity of said socket connector and the compression slot so that the free end of said lead wire resists being pulled through said compression slot.

6. The method of claim 4 further comprising the steps of cleaning the free end of the lead wire and then coating at least a portion of the free end of the lead wire with a solderable material prior to disposing the free end of the lead wire within the inner cavity of said socket connector.

7. The method of claim 4 further comprising the step of forming a plurality of compression slots within the side wall of said socket connector.

8. The method of claim 4 further comprising the step of coupling a retention ring around an exterior surface of the side wall of said socket connector so that said retention ring applies a compressing force on said side wall.

9. The method of claim 4 further comprising the step of cleaning the free end of the lead wire prior to inserting the free end of said lead wire within the inner cavity of said socket connector.

10. The method of claim 9 further comprising the step of providing the inner cavity of said socket connector with a layer of electrically conductive adhesive after inserting the free end of said lead wire within said inner cavity.

11. A socket connector for use in securing a lead wire to a post terminal, comprising:

a top wall having a periphery;

a generally annular side wall extending generally perpendicularly from the periphery of said top wall; said top wall and said side wall being shaped to form an inner cavity to receive at least a portion of the post terminal;

at least one compression slot formed in said side wall; said compression slot being shaped to receive at least a portion of the lead wire; and a layer of solderable material disposed within said inner cavity adjacent said top wall.

12. The socket connector of claim 11 wherein said layer of solderable material is comprised of tin.

13. The socket connector of claim 12 further comprising a layer of flux adjacent said layer of solderable material.

14. A socket connector for use in securing a lead wire to a post terminal, comprising:

a top wall having a periphery;

a generally annular side wall extending generally perpendicularly from the periphery of said top wall; said top wall and said side wall being shaped to form an inner cavity to receive at least a portion of the post terminal;

at least one compression slot formed in said side wall; said compression slot being shaped to receive at least a portion of the lead wire; and a layer of electrically conductive adhesive within said inner cavity adjacent said top wall.

15. A socket connector for use in securing a lead wire to a post terminal, comprising:

a top wall having a periphery;

a generally annular side wall extending generally perpendicularly from the periphery of said top wall; said top wall and said side wall being shaped to form an inner cavity to receive at least a portion of the post terminal;

at least one compression slot formed in said side wall; said compression slot being shaped to receive at least a portion of the lead wire; and an insulation cover shaped to cover at least a portion of the post terminal, the lead wire and said top and side walls.

16. A socket connector for use in securing a lead wire to a post terminal, comprising:

a top wall having a periphery;

a generally annular side wall extending generally perpendicularly from the periphery of said top wall; said top wall and said side wall being shaped to form an inner cavity to receive at least a portion of the post terminal; and a plurality of compression slots formed in said side wall; said compression slots being shaped to receive at least a portion of the lead wire.

17. The socket connector of claim 16 wherein each of said plurality of compression slots is shaped to receive different sized lead wires.

18. A method of securing a lead wire to a terminal, comprising the steps of:

providing the terminal with a base, having a post member, and a socket connector, having a top wall with a periphery and a side wall extending from said periphery; said side wall having at least one compression slot formed therein; said top and side walls being shaped to form an inner cavity;

cleaning a free end of the lead wire;

providing the inner cavity of said socket connector with a layer of solderable material prior to inserting said free end of the lead wire within the inner cavity of said socket connector;

positioning said free end of the lead wire within the inner cavity of said socket connector so that the lead wire exits said socket connector through said compression slot; and positioning at least a portion of the post member of said base within the inner cavity of said socket connector.

19. The method of claim 18 further comprising the step of melting the layer of solderable material within said inner cavity after the step of positioning the free end of the lead wire within said inner cavity so that at least a portion of said inner cavity and the free end of the lead wire are engaged by the layer of solderable material.

20. The method of claim 18 further comprising the step of coating at least a portion of the free end of the lead wire with a solderable material prior to disposing the free end of the lead wire within the inner cavity of said socket connector.

21. The method of claim 20 further comprising the step of melting the layer of solderable material within said inner cavity and the coating of solderable material on the free end of the lead wire after the step of positioning the free end of the lead wire within said inner cavity to secure the lead wire to said socket connector.

22. A method of securing a lead wire to a terminal, comprising the steps of:

providing the terminal with a base, having a post member, and a socket connector, having a top wall with a periphery and a side wall, extending from said periphery; said side wall having at least one compression slot formed therein; said top and side walls being shaped to form an inner cavity;

cleaning a free end of the lead wire;

positioning said free end of the lead wire within the inner cavity of said socket connector so that the lead wire exits said socket connector through said compression slot;

melting solderable material closely adjacent said free end of the lead wire after said free end of the lead wire has been positioned within the inner cavity of said socket connector so that the molten solderable material will engage at least a portion of said free end of the lead wire and the inner cavity of said socket connector; and positioning at least a portion of the post member of said base within the inner cavity of said socket connector.

23. A method of securing a lead wire to a terminal, comprising the steps of:

providing the terminal with a base, having a post member, and a socket connector, having a top wall with a periphery and a side wall extending from said periphery; said side wall having at least one compression slot formed therein; said top and side walls being shaped to form an inner cavity;

cleaning a free end of the lead wire;

positioning said free end of the lead wire within the inner cavity of said socket connector so that the lead wire exits said socket connector through said compression slot;

welding said free end of the lead wire within the inner cavity of said socket connector; and positioning at least a portion of the post member of said base within the inner cavity of said socket connector.

24. A method of securing a lead wire to a terminal, comprising the steps of:

providing the terminal with a base, having a post member, and a socket connector, having a top wall with a periphery and a side wall extending from said periphery; said side wall having at least one compression slot formed therein; said top and side walls being shaped to form an inner cavity;

cleaning a free end of the lead wire;

providing the inner cavity of said socket connector with a layer of electrically conductive adhesive prior to inserting said free end of the lead wire within the inner cavity of said socket connector;

positioning said free end of the lead wire within the inner cavity of said socket connector so that the lead wire exits said socket connector through said compression slot; and positioning at least a portion of the post member of said base within the inner cavity of said socket connector.

25. A method of securing a lead wire to a terminal, comprising the steps of:

providing the terminal with a base, having a post member, and a socket connector, having a top wall with a periphery and a side wall extending from said periphery; said side wall having at least one compression slot formed therein; said top and side walls being shaped to form an inner cavity;

cleaning a free end of the lead wire;

positioning said free end of the lead wire within the inner cavity of said socket connector so that the lead wire exits said socket connector through said compression slot;

providing the inner cavity of said socket connector with a layer of electrically conductive adhesive after positioning said free end of the lead wire within the inner cavity of said socket connector; and positioning at least a portion of the post member of said base within the inner cavity of said socket connector.

26. A method of securing a lead wire to a terminal, comprising the steps of:

providing the terminal with a base, having a post member, and a socket connector, having a top wall with a periphery and a side wall extending from said periphery; said side wall having at least one compression slot formed therein; said top and side walls being shaped to form an inner cavity;

cleaning a free end of the lead wire and then coating at least a portion of said free end of the lead wire with a solderable material prior to positioning said free end of the lead wire within the inner cavity of said socket connector;

positioning said free end of the lead wire within the inner cavity of said socket connector so that the lead wire exits said socket connector through said compression slot; and positioning at least a portion of the post member of said base within the inner cavity of said socket connector.

27. A method of securing a lead wire to a terminal, comprising the steps of:

providing the terminal with a base, having a post member; and a socket connector, having a top wall with a periphery and a side wall extending from said periphery; said side wall having a plurality of compression slots formed therein; said top and side walls being shaped to form an inner cavity;

positioning a free end of the lead wire within the inner cavity of said socket connector so that the lead wire exits said socket connector through at least one of said compression slots; and positioning at least a portion of the post member of said base within the inner cavity of said socket connector.

28. The method of claim 27 wherein said plurality of compression slots are each shaped to receive different sizes of lead wires.

* * * * *